US008944142B2

(12) United States Patent
Nikrityuk et al.

(10) Patent No.: US 8,944,142 B2
(45) Date of Patent: Feb. 3, 2015

(54) METHOD AND DEVICE FOR THE ELECTROMAGNETIC STIRRING OF ELECTRICALLY CONDUCTIVE FLUIDS

(71) Applicants: Helmholtz-Zentrum Dresden-Rossendorf E.V., Dresden (DE); Technische Universitaet Dresden, Dresden (DE)

(72) Inventors: Petr A. Nikrityuk, Edmonton (DE); Sven Eckert, Dresden (DE); Dirk Raebiger, Dresden (DE); Bernd Willers, Crossen (DE); Kerstin Eckert, Dresden (DE); Roger Grundmann, Bannewitz (DE); Gunter Gerbeth, Dresden (DE)

(73) Assignees: Helmholtz-Zentrum Dresden-Rossendorf E.V., Dresden (DE); Technische Universitaet Dresden, Dresden (DE)

( * ) Notice: Subject to any disclaimer, the term of this patent is extended or adjusted under 35 U.S.C. 154(b) by 0 days.

(21) Appl. No.: 14/094,350

(22) Filed: Dec. 2, 2013

(65) Prior Publication Data

US 2014/0290433 A1 Oct. 2, 2014

Related U.S. Application Data

(60) Division of application No. 12/672,036, filed on Aug. 11, 2011, now abandoned, and a continuation of application No. PCT/DE2008/001260, filed on Aug. 1, 2008.

(30) Foreign Application Priority Data

Aug. 3, 2007 (DE) ..... 10 2007 037 340

(51) Int. Cl.

| | |
|---|---|
| ***B22D 27/02*** | (2006.01) |
| ***B22D 27/04*** | (2006.01) |
| ***B01F 13/08*** | (2006.01) |

(52) U.S. Cl.

CPC ..... *B22D 27/02* (2013.01); *B01F 13/0809* (2013.01); *B22D 27/045* (2013.01)

USPC ..... 164/498; 164/499; 164/147.1; 164/122.1

(58) Field of Classification Search

CPC ..... B22D 27/02; B22D 27/045

USPC ..... 164/122.1, 122.2, 147.1, 466–468, 498, 164/499, 502–504

See application file for complete search history.

(56) References Cited

U.S. PATENT DOCUMENTS

| | | | | |
|---|---|---|---|---|
| 3,656,537 | A | 4/1972 | Von Starck | |
| 4,969,501 | A | 11/1990 | Brokloff et al. | |
| 5,769,147 | A | 6/1998 | Yanagimoto et al. | |
| 6,402,367 | B1 | 6/2002 | Lu et al. | |
| 6,637,927 | B2 * | 10/2003 | Lu et al. | 366/273 |
| 2002/0092642 | A1 | 7/2002 | Sasai et al. | |
| 2003/0106667 | A1 | 6/2003 | Beitelman | |
| 2005/0061474 | A1 | 3/2005 | Gelorme et al. | |
| 2010/0163207 | A1 | 7/2010 | Nitrityuk et al. | |

FOREIGN PATENT DOCUMENTS

| | | | |
|---|---|---|---|
| DE | 1962341 | A1 | 6/1971 |
| DE | 2401145 | A1 | 10/1974 |
| DE | 3730300 | A1 | 3/1989 |
| DE | 102004017443 | B3 | 4/2005 |
| GB | 1454052 | A | 10/1976 |
| JP | S5029909 | U | 4/1975 |
| JP | 09182941 | A | 7/1997 |
| JP | 2004501770 | A | 1/2004 |
| JP | 2005066613 | A | 3/2005 |

OTHER PUBLICATIONS

P. A. Nikrityuk et al., "Numerical Study of Spin-Up Dynamics of a Liquid Metal Stirred by Rotating Magnetic Fields in a Cylinder with the Upper Free Surface", Magnetohydrodynamics vol. 40 (2004), No. 2, pp. 127-146.

P. A. Nikrityuk et al., "Axisymmetric Modelling of the Mixing of Two Miscible Liquid Metals Driven by a Rotating Magnetic Field", Conference on Turbulence and Interactions TI2006, May 29-Jun. 2, 2006, Porquerolles, France.

Moeinipour, et al: "Influence of the rotating Magnetic Field on the Microstructure and the Dendrites of the Cast Alloy EN AC—Al Si7Mg", XP-001236781, Dec. 2004, pp. 18-20, 22 and 23, Budapest, Hungary. English translation.
http://en.wikipedia.org/wiki/Three-phase_electric_power, date unknown.

* cited by examiner

*Primary Examiner* — Kevin E Yoon
(74) *Attorney, Agent, or Firm* — Laurence A. Greenberg; Werner H. Stemer; Ralph E. Locher

(57) ABSTRACT

The invention relates to a method and to a device for the electromagnetic stirring of electrically conductive fluids in the liquid state and/or in the state of onsetting solidification of the fluid, using a rotating magnetic field that is produced in the horizontal plane of a Lorentz force. The aim is to achieve an intensive three-dimensional flow on the inside of the fluid for mixing in the liquid state up to the direct vicinity of solidifying fronts, and to simultaneously ensure an undisturbed, free surface of the fluid. The solution is to change the direction of rotation of the magnetic field rotating in the horizontal plane at regular time intervals in the form of a period duration, wherein the frequency of the directional change of movement of the magnetic field vector is adjusted such that in the state of mixing the liquid fluid a period duration is adjusted between two directional changes of the magnetic field during a time interval as a function of the adjustment time with the condition (I) $0.5 \cdot t_{i.a} < T_{PM} < 1.5 \cdot t_{i.a}$ and such that, at the beginning of the state of onsetting solidification of the fluid, a period duration is set between two directional changes of the magnetic field in a time interval as a function of the adjustment time with the condition (II) $0.8 \cdot t_{i.a} < T_{PE} < 4 \cdot t_{i.a}$, wherein the adjustment time; is specified by the equation (III) in which after an activation of the rotating magnetic field in a fluid in the resting state the double vortex of the meridional secondary flow forms, and in which $\sigma$ is defined as the electric conductivity, $\rho$ as the density of the fluid, $\omega$ as the frequency, $B_0$ as the amplitude of the magnetic field, and $C_g$ as the constant for the influence of the size and shape of the volume of the fluid.

7 Claims, 9 Drawing Sheets

Fig. 1
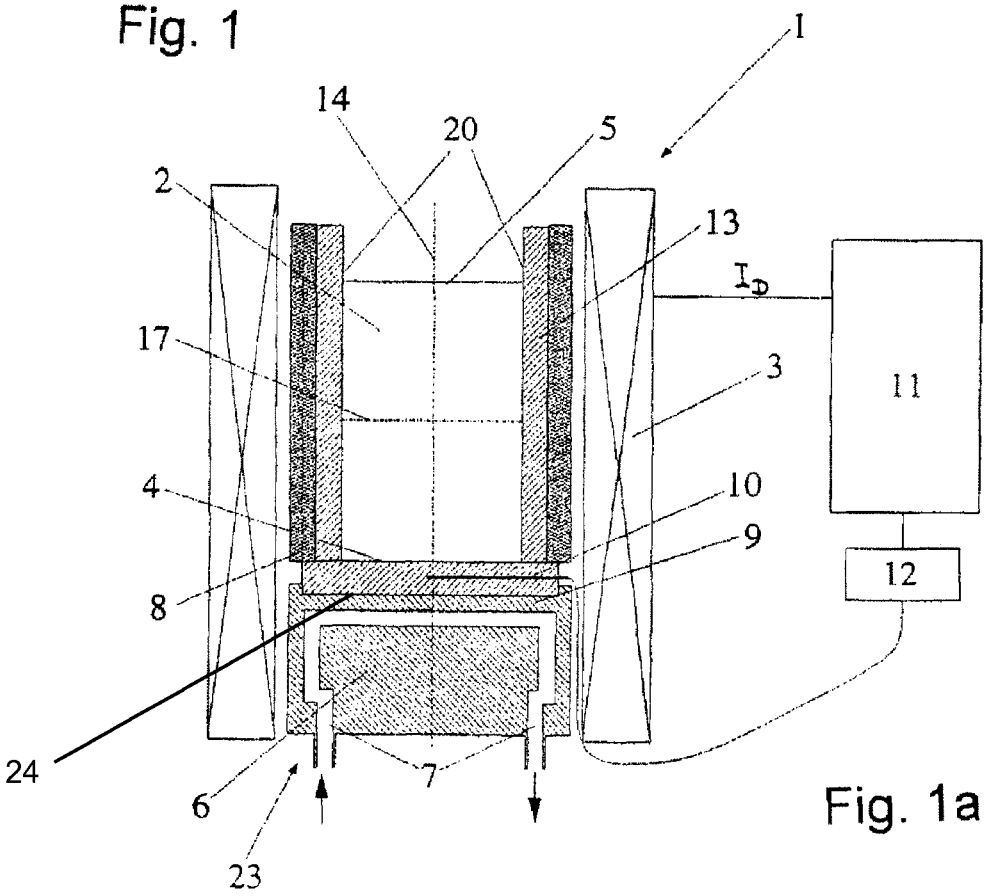
Fig. 1a
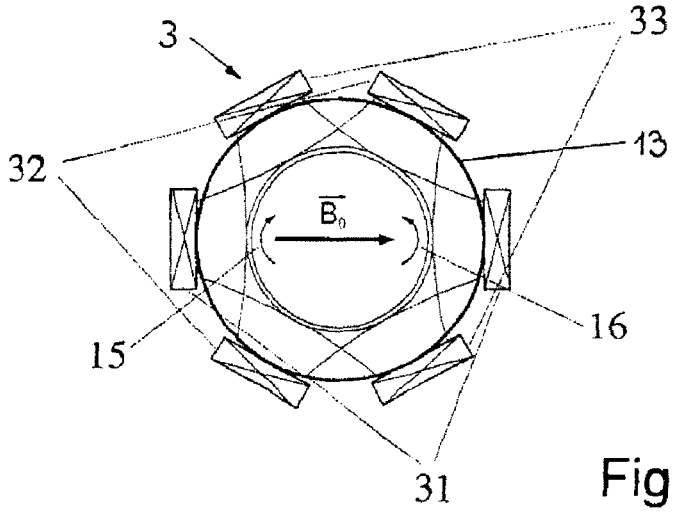
Fig. 1b

Fig. 2
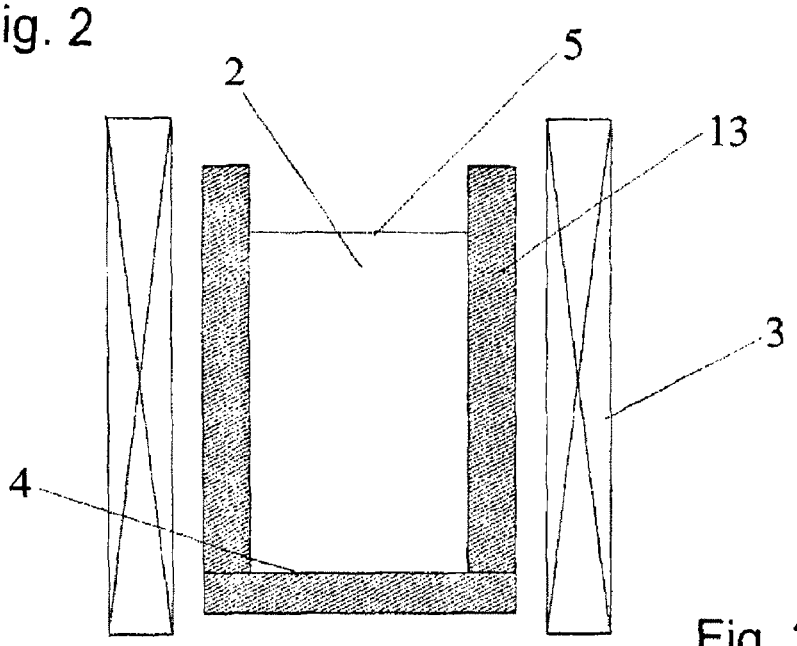
Fig. 2a
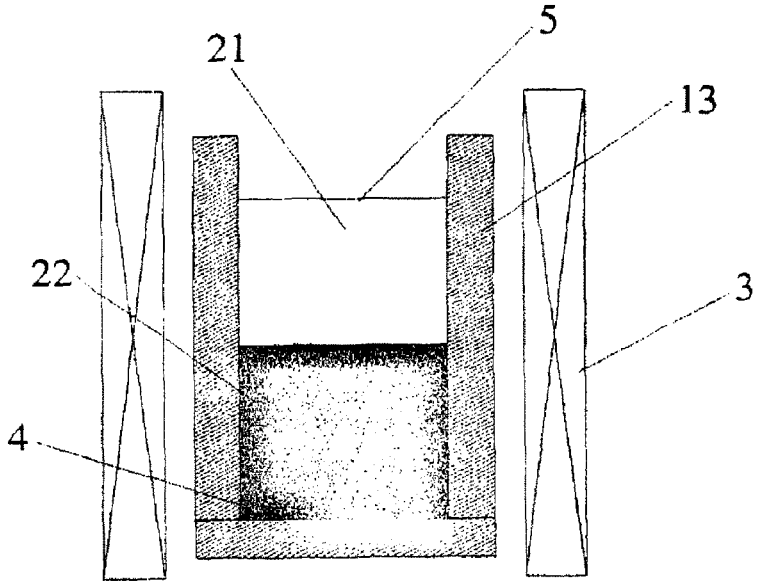
Fig. 2b

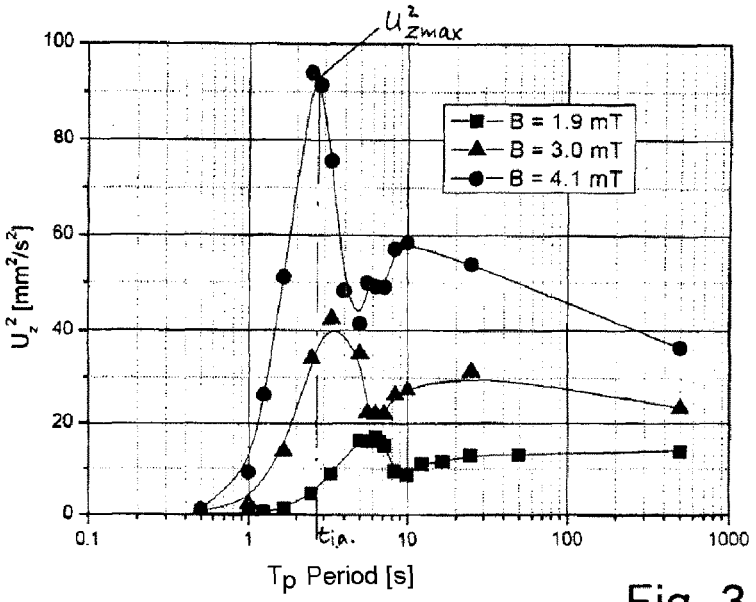
Fig. 3
Fig. 4
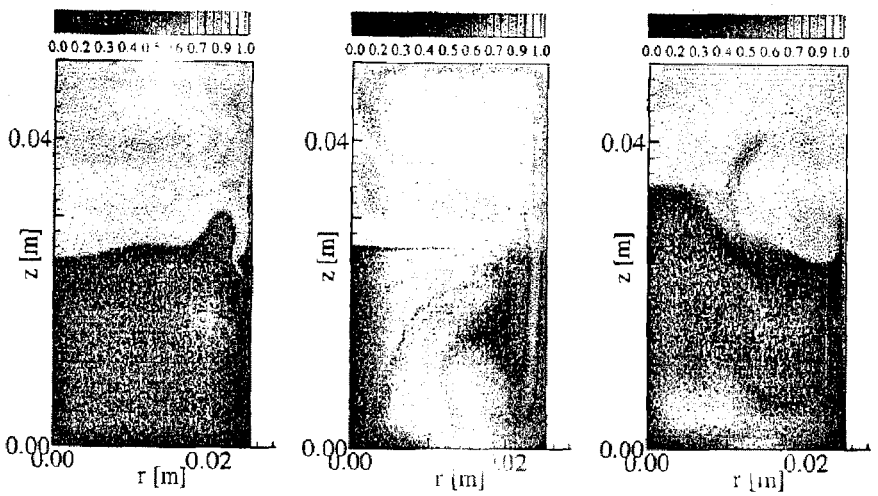
Fig. 4a Fig. 4b Fig. 4c

Fig. 6
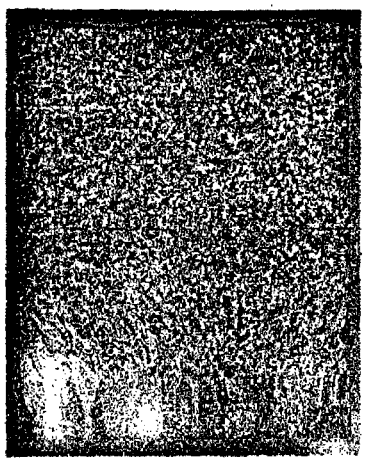
Fig. 6a
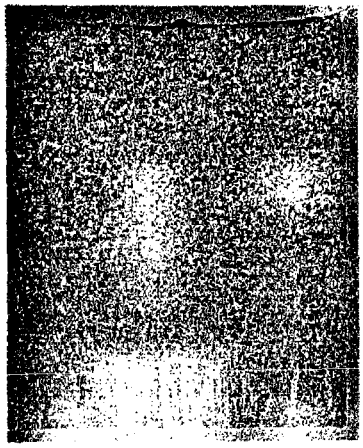
Fig. 6b
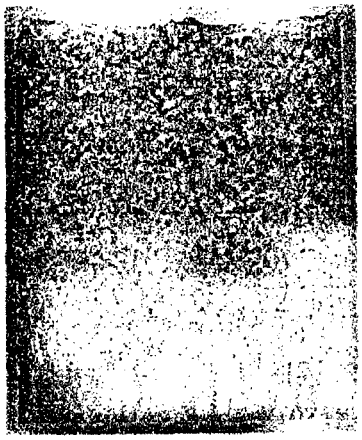
Fig. 6c

Fig. 7
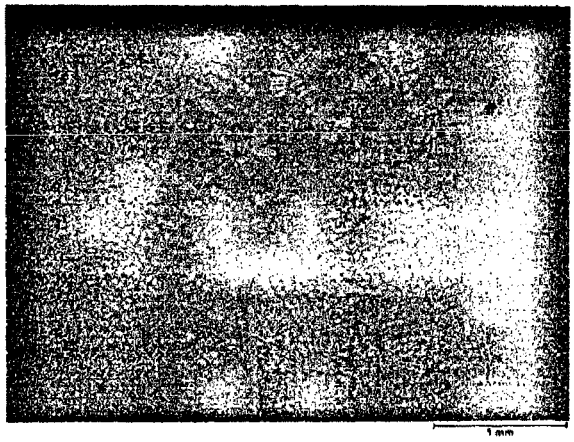
Fig. 7a
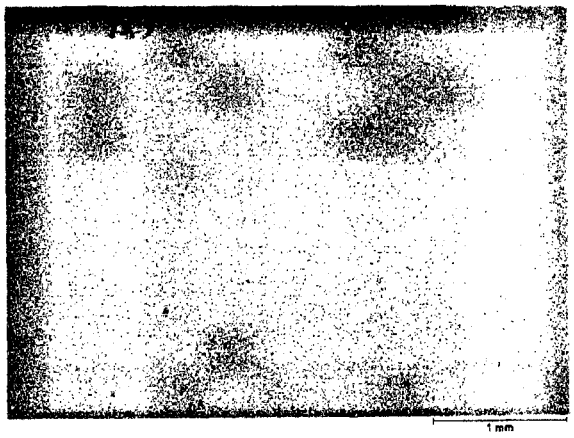
Fig. 7b

METHOD AND DEVICE FOR THE ELECTROMAGNETIC STIRRING OF ELECTRICALLY CONDUCTIVE FLUIDS

CROSS-REFERENCE TO RELATED APPLICATION

This is a divisional application of U.S. patent application Ser. No. 12/672,036, filed Aug. 11, 2011; which was a continuation application, under 35 U.S.C. §120, of International application PCT/DE2008/001260, filed Aug. 1, 2008; the application also claims the priority, under 35 U.S.C. §119, of German patent application No. DE 10 2007 037 340.8, filed Aug. 3, 2007; the prior applications are herewith incorporated by reference in their entirety.

BACKGROUND OF THE INVENTION

Field of the Invention

The invention relates to a method and a device for the electromagnetic stirring of electrically conductive fluids in the liquid state and/or during the solidification of the fluids by using a rotating magnetic field which produces a Lorentz force in the horizontal plane.

Because of the contactless interaction with electrically conductive fluids, time-dependent electromagnetic fields open up a possibility for mixing liquid metal melts, for example. The electromagnetic field can be directly and accurately regulated in a simple way via the parameters of magnetic field amplitude and frequency.

The present invention relates to magnetic traveling fields circulating mostly in a horizontal direction, also denoted as rotating magnetic fields.

The application of a rotating magnetic field, for example to a cylindrical container filled with liquid metal melt, causes over wide regions almost rigid rotational motion of the metal melt that makes scarcely any contribution to the convective exchange in the volume of the melt. The agent responsible for the mixing processes that are to be observed is essentially the so-called meridional secondary flow, which results in the meridional plane (r-z plane) on the basis of the pressure difference between the middle of the container and the primary layers at the bottom and at the free surface, and whose amplitude turns out to be less by a factor of approximately five to ten than the rotating azimuthal flow, depending on the geometry of the observed flow. As is described in the publication by P. A. Nikrityuk, M. Ungarish, K. Eckert and R. Grundmann: Spin-up of a liquid metal flow driven by a rotating magnetic field in a finite cylinder: A numerical and analytical study, Phys. Fluids, 2005, vol. 17, 067101, a so-called double vortex structure is formed in the meridional plane, that is to say in the region of the horizontal central plane of the container the liquid metal melt is transported radially outward, flows upward and downward on the side walls and flows back again to the axis at the bottom and below the free surface. The direction of the secondary circulation is set up in the same way for both directions of rotation of the magnetic field.

A substantial problem with regard to the application of a rotating magnetic field for electromagnetic stirring consists in that the predominant fraction of the kinetic energy of the melt is used for the primary azimuthal rotational motion which, however, makes only a slight contribution to the mixing of the melt. An intensification of the mixing process is possible first and foremost by a boosting of the meridional secondary flow. Increasing magnetic field strength or magnetic field frequency effects a stimulation of the secondary flow, that is to say an increase in the speed values in axial and radial directions, and the production of additional turbulence, for example the occurrence of Taylor-Görtler vortices, as described in the publications by P. A. Nikrityuk, K. Eckert, R. Grundmann: Magnetohydrodynamics, 2004, 40, pp. 127-146 and P. A. Nikrityuk, K. Eckert, R. Grundmann: CD Proceeding of the Conference on Turbulence and Interactions TI2006, France, 2006, May 28-Jun. 2, 2006, in the vicinity of the side walls. This leads to a more intensive mixing of the liquid metal melt.

A problem consists in the fact that, however, the rotational motion is also simultaneously amplified and causes obvious disturbances and displacements of the free surface of the liquid metal melt. This can lead to undesired effects, such as the inclusion of slag in the melt or the absorption of oxygen from the atmosphere.

A further problem occurs for the electromagnetic stirring in the transition from the liquid state to the state of solidification, that is to say during the directional solidification of metallic alloys or semiconductor melts. In the immediate surroundings of an advancing solidification front, the melt separates out on the basis of the different solubility of individual components in the liquid or solid phase. A flow in the immediate surroundings of the solidification front counteracts the build up of an extended concentration boundary layer by virtue of the fact that enriched melt is transported away from the solidification front. If the melt flows exclusively in one direction in this case, separations can, however, come about in other volume regions and noticeably degrade the mechanical properties of the resulting solid body.

Rotating magnetic fields have already found use in metallurgical processes such as continuous casting of steel. To this end, an arrangement of a multiphase electromagnetic winding for producing a traveling field perpendicular to the casting direction in a continuous casting plant is described in publication DE-B 1 962 341.

A method for stirring the steel melt during continuous casting is also described in publication US 2003/0106667 in the case of which use is made of two magnetic fields that are arranged superposed on one another and rotating in opposite senses. While the lower magnetic field takes over the actual function of stirring, the upper magnetic field has the task of braking the rotating melt in the region of the free surface to very low speed values in order to compensate the negative effects of the stirring—a displacement and turbulence of the free surface.

A problem consists in that the operation makes use of two magnetic stirrers—a lower magnetic stirrer and an upper magnetic stirrer. By comparison with the use of only one magnetic system, this signifies a higher outlay on apparatus and regulation. At the same time, such a method has an unfavorable energy balance. The lower magnetic stirrer is used to put mechanical energy into the steel melt and to set the steel melt rotating. However, since a far less intensive rotation of the melt is desired by the user in the upper region of the continuous casting plant, this mode of procedure requires additional energy to be applied in the upper magnetic stirrer in order to brake the flow there.

Publications DE 2 401 145 and DE 3 730 300 respectively describe methods for electromagnetic stirring in continuous casting molds in the case of which a periodic change is undertaken in the current in the coil arrangement. It is described in publication DE 2 401 145 that this mode of procedure can be used to avoid the formation of secondary thin strips and secondary dendrites.

A calming of the free bath surface is achieved with the method described in publication DE 3 730 300. It is assumed that the resulting magnetic field in the interior of the melt simultaneously maintains an intensive stirring motion. In the two last-mentioned publications, very wide ranges, specifically between one second and 30 seconds, are specified for the cycle times in which the direction of flow is to be changed. The cycle time, also termed period, or the frequency of the change in sign of the current is an important parameter with a strong influence on the flow that forms.

A problem consists in the fact that neither publication describes any details relating to a prescribable period as a function of the magnetic field strength, the geometry of the arrangement of induction coils or the material properties of the liquid metal melt.

SUMMARY OF THE INVENTION

It is the object of the invention to specify a method and a device for the electromagnetic stirring of electrically conductive fluids that are suitably designed in such a way that an intensive three-dimensional flow is achieved in the interior of the fluid for the purpose of mixing in the liquid state as far as the immediate surroundings of solidification fronts, and at the same time an undisturbed, free surface of the fluid is ensured.

The object is achieved by the features of patent claims 1 and 9. In the method for the electromagnetic stirring of electrically conductive fluids in the liquid state and/or in the state at the beginning of the solidification of the fluid by using a rotating magnetic field which produces a Lorentz force $F_L$ in the horizontal plane, in the characterizing part in accordance with patent claim 1

- the direction of rotation of the magnetic field rotating in the horizontal plane is changed in regular time intervals in the form of a period $T_P$, the frequency of the change in direction of the movement of the magnetic field vector being set in such a way that
- in the state of the mixing of the fluid a period $T_P$ between two changes in direction of the magnetic field in a time interval $\Delta T_{PM}$ is adjusted as a function of the initial adjustment time $t_{i.a.}$ with the condition that and $$0.5 \cdot t_{i.a.} < T_{PM} < 1.5 \cdot t_{i.a.} \quad \text{(I)}$$

and

- at the beginning of the state of solidification of the fluid a period $T_P$ is adjusted between two changes in direction of the magnetic field in a time interval $\Delta T_{PE}$ as a function of the initial adjustment time $t_{i.a.}$ with the condition that $$0.8 \cdot t_{i.a.} < T_{PE} < 4 \cdot t_{i.a}, \quad \text{(II)}$$

the initial adjustment time $t_{i.a.}$ being given by the equation $$t_{i.a.} = C_g \cdot \left( B_0 \sqrt{\frac{\sigma\omega}{\rho}} \right)^{-1} \quad \text{(III)}$$

in which after the rotating magnetic field is switched on in a fluid in a state of rest the double vortex of the meridional secondary flow is formed, and $\sigma$ is defined as the electrical conductivity, $\rho$ as the density of the fluid, $\omega$ as a frequency and $B_0$ as the amplitude of the magnetic field, and $C_g$ is defined as a constant for the influence of the size and shape of the volume of the fluid.

In order to form the rotating magnetic field, it is possible to apply a rotary current $I_D$ in the form of a three-phase alternating current to at least three pairs of induction coils placed on a cylindrical container containing the fluid.

Metal or semiconductor melts can be poured as electrically conductive fluids into the container.

Consequently, during the mixing of a cooling melt a period $T_P$ is selected according to condition (I) with $0.5 \cdot t_{i.a.} < T_{PM} < 1.5 \cdot t_{i.a.}$, as long as the melt is still completely liquid, whereas at the beginning of the state of solidification the period $T_P$ is lengthened such that $0.8 \cdot t_{i.a.} < T_{PE} < 4 \cdot t_{i.a.}$ is satisfied according to condition (II).

The amplitude $B_0$ of the magnetic field can be corrected in accordance with the height $H_0$ of the volume of the melt, which decreases in the course of the state of the directional solidification.

In the state of a directional solidification under temperature control the amplitude $B_0$ of the magnetic field is to be increased such that at least the maximum of the two values $$B_1 = \sqrt{\frac{\rho}{\sigma\omega}} \cdot \frac{100 \cdot V_{sol}}{H_0} \quad \text{(IV)}$$

and $$B_2 = \sqrt{\frac{\rho}{\sigma\omega}} \cdot \frac{40 \cdot V_{sol}^{\frac{3}{2}}}{\sqrt{H_0 \nu}} \quad \text{(V)}$$

is reached, $\nu$ being defined as the kinematic viscosity of the melt, $V_{sol}$ being defined as the rate of solidification, and $H_0$ being defined as the height of the melt volume and $B_1$ and $B_2$ as lower limit values of the amplitude $B_0$ of the magnetic field, which can vary in the course of the solidification as a function of the parameters $\nu$, $V_{sol}$ and $H_0$.

The respective periods during mixing $T_{PM}$ and the beginning of solidification $T_{PE}$ in which the magnetic field is present and switched on are interrupted by pauses of pause duration $T_{Pause}$ in which no magnetic field is present at the melt, the pause duration $T_{Pause}$ being adjusted relative to the respective period $T_P$ with $T_{Pause} \leq 0.5 \cdot T_P$.

Other pulse shapes such as, for example, sine, triangle or sawtooth can be implemented instead of the rectangular function when modulating the profile of the electromagnetic force $F_L$, the profile and the maximum value of the amplitude $B_0$ of the magnetic field being defined such that an identical energy input results for the various pulse shapes.

The device for the electromagnetic stirring of electrically conductive fluids in the liquid state and/or in the state at the beginning of the solidification of the fluid by using a rotating magnetic field which produces a Lorentz force $F_L$ in the horizontal plane, and under the control of the temperature profile of the fluid by means of the inventive method comprises at least a cylindrical container, a centrally symmetrical arrangement, surrounding the container, of at least three pairs of induction coils for forming a rotating magnetic field producing a Lorentz force $F_L$, and at least one temperature sensor for the temperature measurement of the fluid in the container, in which case in accordance with the characterizing part of patent claim 9 the pairs of the induction coils are connected to a control and regulation unit that passes on a rotary current $I_D$ to the pairs of induction coils via a connected power supply unit, the phase angle of the rotary current $I_D$ feeding the pairs of the induction coils being displaced by 180° in regular time intervals and in accordance with the prescribed period $T_{PM}$ for the mixing in the liquid state or $T_{PE}$ for the mixing from the beginning of the solidification, and a reversal of the direction of rotation of the magnetic field and of the Lorentz force $F_L$ driving the flow thereby being achieved, the control/regulation unit being connected to the temperature sensor, whose temperature data at the instant of the beginning of the solidification initiates the switchover of the period from $T_{PM}$ to $T_{PE}$.

The rotary current $I_D$ can be a three-phase alternating current.

The container with the electrically conductive fluid, which can, in particular, be a melt, can preferably be arranged concentrically inside the induction coils.

The container can be provided with a heating device and/or cooling device, which can be connected to a permanently installed metal body.

The container bottom can be in direct contact with a solid metal body through whose interior a cooling medium flows.

The side walls of the container can be thermally insulated.

The cooling body can be connected to a thermostat.

A liquid metal film can be located between the cooling body and the container in order to attain a stable heat transfer in conjunction with a low transfer resistance.

The liquid metal film can consist of a gallium alloy.

Positioned in the base plate and/or the side walls of the container in which the melt is located may be at least one temperature sensor, for example in the form of a thermocouple that supplies an information signal relating to the instant of the beginning of the solidification, and is connected to the control and regulation unit.

The use of the inventive device for the electromagnetic stirring of electrically conductive fluids can be performed as claimed in claims 9 to 18 in the form of metallic melts in metallurgical processes, or in the form of semiconductor melts in crystal growth for the purpose of cleaning metal melts, during continuous casting or during the solidification of metallic materials by means of the inventive method as claimed in claims 1 to 8.

The direction of the rotating magnetic field is reversed at entirely specific, regular time intervals. The reversal is performed by means of the control device for displacing the phases a three-phase alternating current, the result being a reversal in the direction of rotation of the rotating phases of a three-phase alternating current, and thus the reversal of the direction of rotation of the rotating magnetic field.

An intensive meridional secondary flow occurs in the period of the reversal of the direction of flow at the same time as a simultaneously more weakly expressed azimuthal rotational motion, the constantly recurring change in direction giving rise to an intensive mixing. The efficient adjustment of the duration of the period $T_P$ between two changes in direction plays a decisive role here.

The following stipulation holds in accordance with the invention:

For an intensive mixing of the melt in conjunction with a low energy outlay, the condition:

$$0.5 \cdot t_{i.a.} < T_P < 1.5 \cdot t_{i.a.} \quad \text{(I)}$$

holds, or for a controlled solidification accompanied by avoidance of the formation of separation zones in the solidification structure the condition:

$$0.8 \cdot t_{i.a.} < T_P < 4 \cdot t_{i.a}, \quad \text{(II)}$$

holds.

The parameter $t_{i.a.}$ constitutes an initial adjustment time in which the double vortex typical of the meridional secondary flow has formed after abrupt switching on of a rotating magnetic field in a melt that was already in the state of rest.

The characteristic initial adjustment time $t_{i.a.}$ is calculated with the aid of a formula from the variables of electrical conductivity of the melt, density of the melt and frequency and amplitude of the magnetic field. An associated constant takes account of the influence of the size and shape of the melt volume, and can assume numerical values of between three and five. It follows that by contrast with the prior art, in particular with publication DE 3 730 300, there is a defined range for the period $T_P$ in which the change in the direction of rotation can be set.

An essential feature of the invention consists in the fact that the direction of the rotating magnetic field is reversed at regular time intervals, the period $T_P$ of the change in direction constituting an important parameter that can be specified in order to render the stirring intensive. An essential criterion for the success of the method is the possibility of targeted control of the secondary flow. Different flow forms are advantageous for various goals.

The present invention can advantageously be used for the efficient stirring of melts and in the case of the directional solidification of multicomponent melts. In order to maximize a mixing effect appearing in this case, for example during the cleaning or the degassing of melts, it is necessary to amplify the intensity of the volume-averaged meridional secondary flow by comparison with the primary azimuthal rotational motion. When the method is applied in the directional solidification of metallic alloys, setting the goal consists in that in addition to a thermal homogenization of the melt the aim is also to vary the direction of the flow in the immediate surroundings of the solidification front in the course of time such that a temporal mean value for the radial speed component which is close to zero results.

The present invention shows that the speed field of the meridional secondary flow depends on variations in the parameter $T_P$ in a clear and comprehensible way. It becomes evident that what is decisive for an efficient design of the method for stirring is the correct adjustment of the period $T_P$ with regard to the setting of the goal of the respective application. The strength of the magnetic field, the dimensions and the shape of the melt volume and the material properties of the melt are to be incorporated when specifying $T_P$.

The invention will be described in more detail below in two exemplary embodiments by means of a plurality of drawings:

Other features which are considered as characteristic for the invention are set forth in the appended claims.

Although the invention is illustrated and described herein as embodied in a method and device for the electromagnetic stirring of electrically conductive fluids, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE SEVERAL VIEWS OF THE DRAWING

FIG. 1 shows a schematic of an inventive device for electromagnetic stirring for mixing a liquid melt in conjunction with the inventive method;

FIG. 1*a* shows a schematic design of the device in a front view;

FIG. 1*b* shows a plan view of the device according to FIG. 1*a;*

FIG. 2 shows two schematic cylindrical containers with liquid metal melts;

FIG. 2*a* shows a liquid melt of a metal;

FIG. 2*b* shows two melts, located one above another, of two different metals in the state of rest (in the separated state);

FIG. 3 shows the experimentally determined dependence of the intensity of the meridional secondary flow on the period $T_P$;

FIG. 4 shows results of numerical simulations relating to the mixing of liquid lead (Pb) and liquid tin (Sn): mixing behavior at the same time after the beginning of mixing ($t/t_{spin\text{-}up}$=1.92);

FIG. 4*a* shows continuous RMF, $T_P=\infty$;

FIG. 4*b* shows $T_P/t_{i.a.}$=1.03;

FIG. 4*c* shows $T_P/t_{i.a.}$=2;

$$\langle C_{Sn}\rangle = \frac{4\int_0^{H_0/2}\int_0^{R_0} C_{Sn}\, r\, dr\, dz}{R_0^2 H_0}$$

Figure 8:
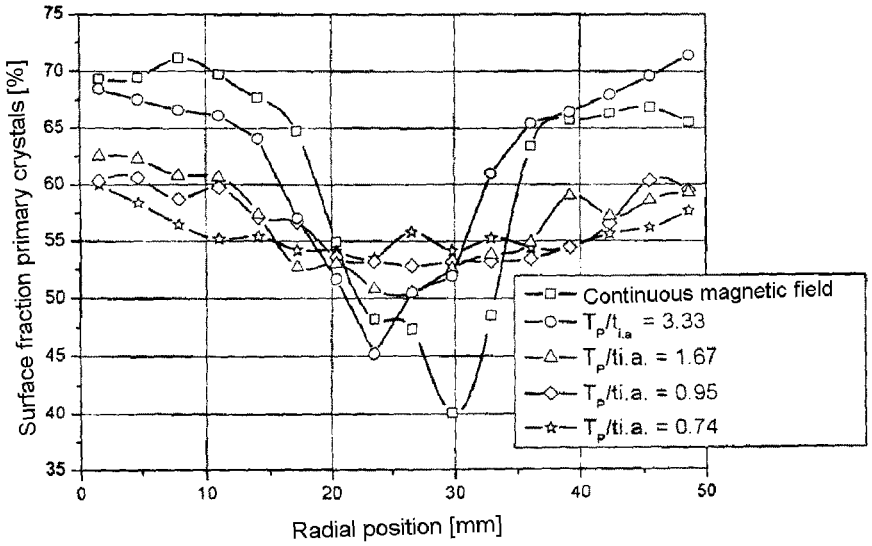

FIG. 6 shows solidification of an Al—Si alloy under the influence of a magnetic field, $B_0$=6.5 mT, (macrostructure);

FIG. 6*a* shows a continuous RMF, $T_P=\infty$;

FIG. 6*b* shows $T_P/t_{i.a.}$=1.67;

FIG. 6*c* shows $T_P/t_{i.a.}$=0.95;

FIG. 7 shows solidification of an Al—Si alloy under the influence of a magnetic field (microstructure);

FIG. 7*a* shows a continuous RMF, $T_P=\infty$;

FIG. 7*b* shows $T_P/t_{i.a.}$=1.67;

FIG. 8 shows a radial distribution of the surface fraction of primary crystals in Al-7 wt % Si samples (with seven Si weight fractions) that were solidified under the influence of a magnetic field with variation of the pulse duration $T_P$.

DETAILED DESCRIPTION OF THE INVENTION

FIGS. 1, 1*a*, 1*b* show a schematic of an inventive device 1 for stirring a fluid, in the liquid state, in the form of a metallic melt 2 by using a rotating magnetic field which produces a Lorentz force $F_L$ in the horizontal plane, the device 1 comprising at least

- a cylindrical container 13 with the liquid melt 2 located therein, as shown in FIG. 2*a*, or 21, 22, as shown in FIG. 2*b*,
- a centrally symmetrical arrangement 3, surrounding the container 13, of at least three pairs 31, 32, 33 of induction coils for forming a rotating magnetic field producing a Lorentz force $F_L$, and
- at least one temperature sensor 10 for the temperature measurement of the fluid 2, 21, 22 in the container 13.

According to the invention, the pairs 31, 32, 33 of the induction coils are connected to a control/regulation unit 12 that passes on a rotary current $I_D$ to the pairs 31, 32, 33 of induction coils via a connected power supply unit 11, the phase angle of the rotary current $I_D$ feeding the pairs 31, 32, 33 of the induction coils being displaced by 180° in regular time intervals in accordance with the prescribed period $T_{PM}$ for the mixing in the liquid state or $T_{PE}$ for the mixing from the beginning of the solidification, and a reversal of the direction of rotation of the magnetic field and of the Lorentz force $F_L$ driving the flow thereby being achieved, the control/regulation unit 12 being connected to the temperature sensor 10, whose temperature data at the instant of the beginning of the solidification initiates the switchover of the period from $T_{PM}$ to $T_{PE}$.

The cylindrical container 13 is filled with the liquid, electrically conductive first melt 2. The container 13 is located in a centrally symmetrical fashion inside the arrangement 3 of the induction coil pairs 31, 32, 33, as is shown in FIG. 1*b*. The induction coil pairs 31, 32, 33 are fed by a power supply unit 11 with a rotary current $I_D$ in the form of a three-phase alternating current, and produce a magnetic field that rotates about the axis of symmetry 14 of the container 13 and is horizontally aligned with the direction of rotation 15 (direction of the arrow). The time change in the magnetic field strength produces a Lorentz force $F_L$ with a dominating azimuthal component that sets the melt 2 in FIG. 2*a* or 21, 22 in FIG. 2*b* in rotational motion. The power supply unit 11 of the induction coil pairs 31, 32, 33 is connected to the control/regulation unit 12, which effects a displacement of the phases of the three-phase alternating current $I_D$ in prescribed time intervals. As a consequence of the phase displacement, the direction of rotation 15 of the horizontally aligned magnetic field is reversed during the change in phase into the direction of rotation 16, as shown in FIG. 1*b*.

The method can be used, for example to homogenize the temperature distribution in a single-component melt 2, as shown in FIG. 2*a*, or in order to bring about a concentration compensation in separated multicomponent melts 21, 22, as shown in FIG. 2*b*, the melt 22 with the higher density before the beginning of mixing being located in the lower part of the container 13 and being covered by the lighter melt 21.

The mode of operation of the device 1 is explained in more detail in accordance with FIG. 1 and FIGS. 2*a*, 2*b*.

Figure 1C:
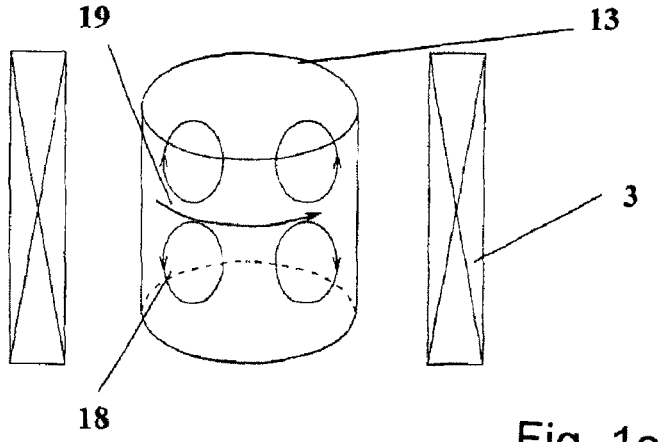
FIG. 1*c* shows a schematic of the types of flow in a magnetic field rotating in the horizontal plane.
Figure 1D:
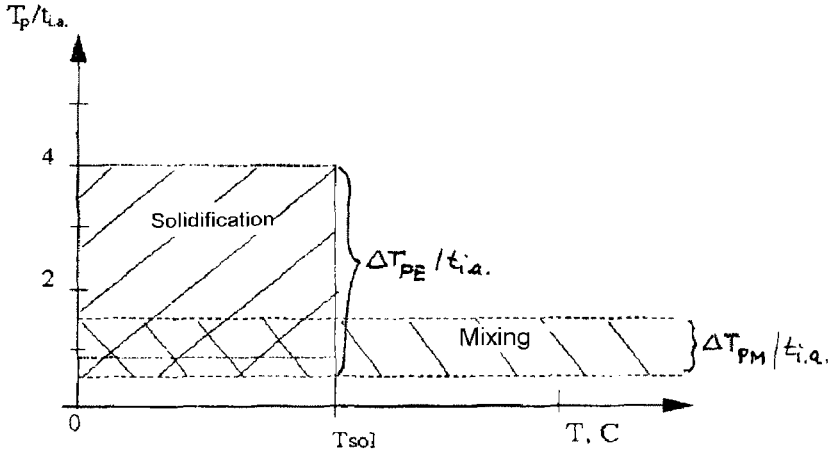
FIG. 1*d* shows a period ($T_P$)–temperature (T) representation of the melt in the liquid state and in the transition to solidification, $T_{sol}$ denoting the temperature of the container bottom at the beginning of the solidification.
Figure 1E:
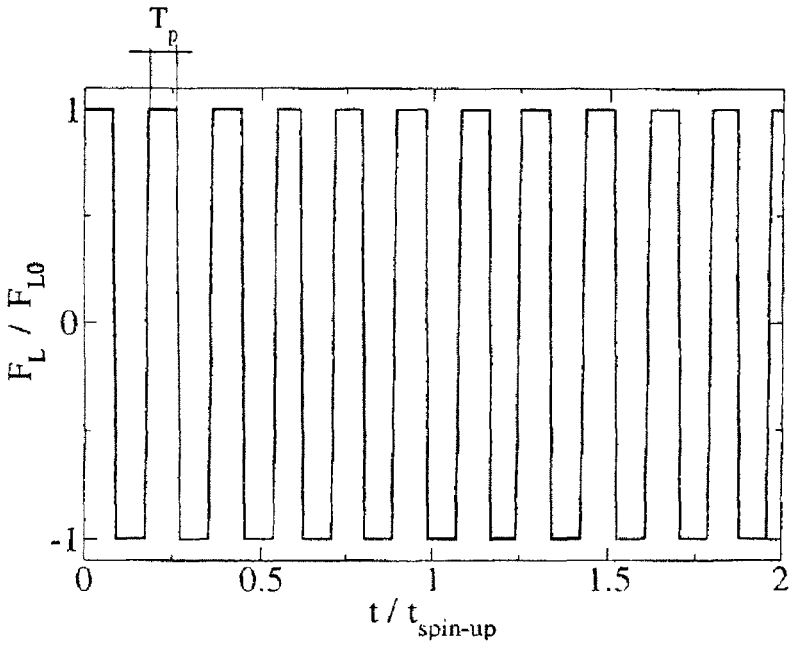
FIG. 1*e* shows a Lorentz force ($F_L/F_{LO}$)–time(t) representation.

The method for electromagnetic stirring is based on a periodic reversal of the direction of the Lorentz force $F_L$ driving the flow. The character of the flow is determined by a periodic change in the direction of rotation 15-16, 16-15 of the magnetic field $B_0$. At the instant of the reversal in direction, the flow is braked and the melt 2; 21, 22 is accelerated in the opposite direction. The Lorentz force $F_L$ varies in an axial direction with the associated force component and has a maximum in the central plane 17 of the container 13. In the event of a polarity reversal of the direction of rotation 15 of the magnetic field, the melt 2; 21, 22 in the surroundings of the central plane 17 is more strongly braked, and accelerated in the opposite direction 16, than is the case in the vicinity of the bottom 4 of the container 13 and of the free surface 5. The non-simultaneities in the reversal of direction 15-16, 16-15 of the flow produce strong gradients in the rotational motion in an axial direction of the axis of symmetry 14. As shown in FIG. 1*c*, the occurrence of such gradients leads to an excitation of the meridional secondary flow 18. In the period of the reversal of the direction of flow, an intensive secondary flow 18 therefore occurs in conjunction with a simultaneous weakly expressed rotational motion 19. The mixing of the melt 2; 21, 22 therefore becomes more efficient the better the intensities of primary azimuthal rotational motion 19 and of the meridional secondary flow 18 can be approximated to one another. This can be achieved over a relatively long period by constantly recurring change in direction of the magnetic field $B_0$. As shown in FIGS. 1*d*, 1*e*, a decisive role is played in this context by the adjustment of the period $T_P$. If the period $T_P$ is too long, the primary azimuthal rotational motion 19 increases significantly in intensity by comparison with the meridional secondary flow 18. A comparatively short period $T_P$ is advantageous, since relatively frequent changes in direction 15-16, 16-15 reinforce the secondary flow 18. However, if the period $T_P$ becomes too short, the melt 2; 21, 22 cannot be sufficiently accelerated, and both the primary rotational motion 19 and secondary flow 18 experience a loss of intensity. Thus, as shown in FIG. 1*e*, there exists a specific optimum value of the period $T_P$ that is a function of the magnetic field strength $B_0$, size and shape of the volume and the material properties of the melt 2; 21, 22.

An efficient stirring of the liquid melt 2; 21, 22, that is to say a maximized stirring action in conjunction with an outlay on energy that is as low as possible, is achieved when the period $T_P$ is defined in accordance with FIG. 1*d* as follows:

$$0.5 \cdot t_{i.a.} < T_P < 1.5 \cdot t_{i.a.} \quad \text{(I).}$$

The parameter $t_{i.a.}$ is the so-called initial adjustment time, and denotes the time scale of the formation of the double vortex that is typical of the meridional secondary flow 18 which formation occurs after an abrupt switching on of a rotating magnetic field in a melt 2; 21, 22 that was previously in a state of rest. The initial adjustment time $t_{i.a.}$ is defined by the following equation $$t_{i.a.} = C_g \cdot \left( B_0 \sqrt{\frac{\sigma \varpi}{\rho}} \right)^{-1}, \quad \text{(III)}$$

the variables σ, ρ, ω and $B_0$ denoting the electrical conductivity and the density of the melt, the frequency and the amplitude of the magnetic field, while the constant $C_g$ describes the influence of the size and shape of the melt volume, and can assume numerical values of between three and five.

In a plexiglass cylinder 13 with a diameter of 2r and a height of 60 mm in each case, the flow of a GaInSn melt 21, 22 was measured with the aid of the ultrasonic Doppler method. FIG. 3 shows the root mean square, measured along an axial line for r=18 mm, of the vertical speed $U_z^2$ as a function of the period $T_P$. The experimental results substantiate the existence of a specific period $T_P$ for which the intensity of the meridional secondary flow 18 reaches a maximum. The position of the maximum $U_{zmax}^2$ varies with the magnetic field strength and corresponds to the respective initial adjustment time $t_{i.a.}$.

As shown in FIG. 2*b*, the invention can be used to intermix various melts 21, 22. For example, half each of liquid lead 22 and liquid tin 21 can be located in the cylindrical container 13. The lead 22 is much heavier and rests in the lower half of the container 13 before the beginning of mixing. At a defined instant, the rotating magnetic field $B_0$ is switched on, its direction of rotation being reversed in regular time intervals. The results of numerical simulations are contained in FIG. 4 and FIGS. 4*a*, 4*b*, 4*c* for a magnetic field of 1 mT with regard to the concentration distribution of lead (black) 22 and tin (white) 21 in an r-z half plane after a specific time of 20 s, in which case in FIG. 4*a*, $T_P$=0

FIG. 4*b*, $T_P$=1.03 $t_{i.a}$

FIG. 4*c*, $T_P$=2 $t_{i.a.}$

Figure 5:
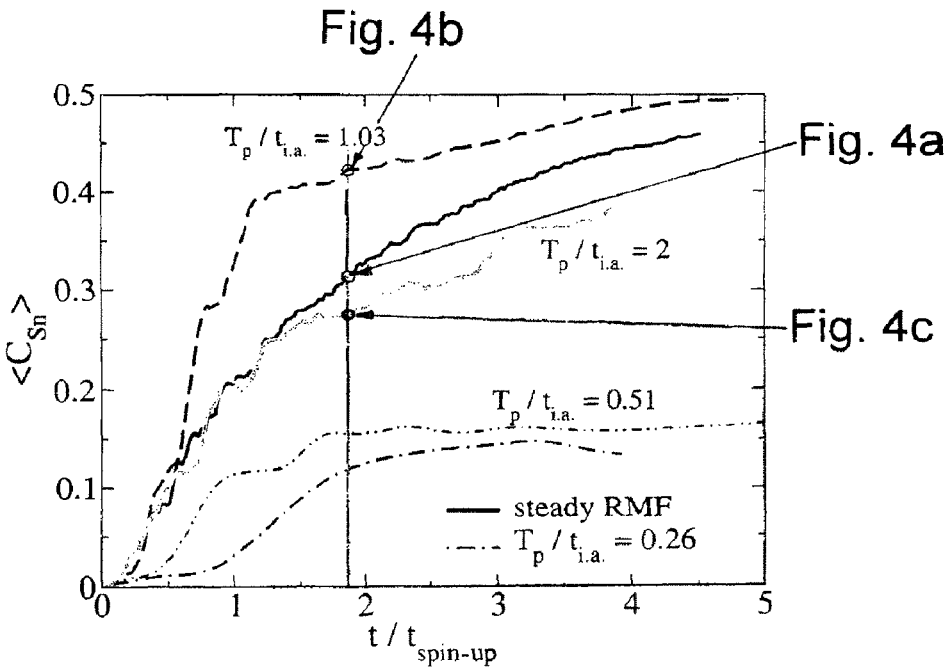
FIG. 5 shows an illustration of the results of numerical simulations relating to the mixing of the tin concentration in the lower container half: temporal development of the volume-averaged Sn concentration in the lower container volume for various scenarios.

A comparison of the results, illustrated in FIG. 5, of numerical simulations of the mixing of the tin concentration $C_{Sn}$ in the lower container half for a time development of the volume-averaged Sn concentration in the lower container volume for various scenarios with reference to the flows in FIGS. 4*a*, 4*b*, 4*c*.

$$\langle C_{Sn} \rangle = \frac{4 \int_0^{H_0/2} \int_0^{R_0} C_{Sn} r \, dr \, dz}{R_0^2 H_0}$$

for various adjusted values of the period $T_P$, shows that the mixing flows ahead most quickly for the period $T_P \approx t_{i.a.}$. The illustration is confirmed by the time development of the tin concentration 21 in the lower container half ($R_0$ being the radius, $H_0$ the height of the container), which is illustrated in FIG. 4*b*. It may be recorded in this context in particular that when the period $T_P$ is adjusted to an unsuitable value poorer results are attained with regard to a homogenization of the melt volume than in the application of a continuously rotating magnetic field.

As shown in FIGS. 1, 1*a*, 1*b*, the device 1, illustrated in FIG. 2, of the cylindrical container 13, filled with an electrically conductive melt 2, in the arrangement 3 of induction coil pairs 31, 32, 33 can be supplemented by a cooling device 23 for the solidification of metallic melts 2. The cooling device 23 includes a metal block 6 in whose interior cooling channels 7 are present. The container 13 stands on the metal block 6. A liquid metal film 24 can be located between the cooling body 9 and the container 13 in order to attain a stable heat transfer in conjunction with a low transfer resistance. During the solidification process, a coolant flows through the cooling channels 7 located in the interior of the metal block 6. The heat is withdrawn downward from the melt 2 by means of the cooling device 23. A thermal insulation 8 of the container 13 prevents heat losses in a radial direction. At least one temperature sensor 10 is fitted on the bottom 4 and the side walls 20 of the container 13, for example in the form of a thermocouple. The temperature measurements enable the beginning and the course of the state of solidification to be monitored, and enable an immediate adaptation of the magnetic field parameters (for example B0 and TP) to the individual stages of the solidification process by the power supply unit 11 controlled by means of the control/regulation unit 12.

The periodic reversal of the direction of the Lorentz force $F_L$ driving the flow is continued for the purpose of continuing to stir the solidifying melt 2. As shown in FIG. 1*d*, the period $T_{PE}$ is set in such a way that the melt 2 is effectively mixed and the direction of the meridional secondary flow 18 is subjected to a constant change in direction in the surroundings of the solidification front.

Al—Si alloys 21, 22 can be directionally solidified under temperature control in the inventive device 1 in accordance with FIGS. 1, 2*b*. The structural properties obtained are explained in more detail with the aid of FIGS. 6*a*, 6*b*, 6*c*, 7*a*, 7*b* and 8 with reference to the formation of columnar dendrites, grain refinement and separation:

FIG. 6 shows the macrostructure in longitudinal section of cylindrical blocks of an Al-7 wt % Si alloy, for example given a diameter of 50 mm and a height of 60 mm, that was directionally solidified under the influence of a rotating magnetic field at field strength $B_0$ of 6.5 mT. In the case present here, the magnetic field was switched on with a time delay of 30 s after the beginning of the solidification at the container bottom. A coarse columnar structure grows parallel to the axis of symmetry of the container in the period up to the beginning of the electromagnetically driven flow. As shown in FIG. 7*a*, in the case of a continuously operating rotating magnetic field there is firstly a formation of a modified columnar structure, that is to say the columnar grains become finer and grow to the side in an inclined fashion. A morphological transition from columnar to equiaxial grain growth is to be observed in the middle of the sample. At the solidification front, the secondary flow transports Si-rich melt toward the axis of symmetry 14. This leads to typical separation patterns that exhibit an impoverishment of eutectic phases in the edge zones, and a concentration in the region of the axis of symmetry 14. This is synonymous with an increase in the fraction of primary crystals near the side walls, and reduction in the fraction of primary crystals in the center of the sample.

FIG. 8 is a radial distribution of the surface fraction of primary crystals in Al-7 wt % Si samples (with seven Si weight fractions) that were solidified under the influence of a magnetic field with variation of the pulse duration $T_P$.

FIGS. 6 to 8 show that a direct transition to equiaxial grain growth can be achieved in the case of electromagnetic stirring with change in direction of the magnetic field and switching on of the magnetic field. The periodic change in the direction of rotation of the magnetic field leads in each case to a reduction in separation, it even being possible to avoid separation almost completely given suitable selection of the pulse duration $T_P$, as shown in FIG. 7*b*.

The advantages of the invention consist in the following:

- formation of an intensive, three dimensional flow in the interior of the metal melt 2; 21, 22,
- very good mixing of the metal melt 2; 21, 22 by intensive meridional secondary flow 18,
- lower energy outlay by comparison with the continuously rotating magnetic field, since the overwhelming portion of the expended energy need not be applied in maintaining the azimuthal rotational flow, and a higher energy fraction is applied to the meridional secondary flow 18, which is more effective for mixing,
- the inventively defined frequency of the periodic reversal in direction of the meridional secondary flow 18 enables determinable values for mixing or for directional solidification,
- disturbances and deflections of the free surface 5, illustrated in FIGS. 1, 2*a*, 2*b*, of the melt 2; 21, 22 with undesired effects such as slag inclusions are avoided,
- during directional solidification, it is possible to avoid the formation of separation zones in the solidification structure, which impair the mechanical properties, and
- there is a need for only one magnetic system, and thus for a lower outlay on apparatus and regulation, by contrast with oppositely rotating systems arranged one above another.

The application of the invention can be used for mixing metal melts 2; 21, 22 for continuous casting, for the directional solidification of mixed metallic alloys, and for directional solidification of semiconductor melts, inter alia.

LIST OF REFERENCE NUMERALS

1 Device
2 First melt
3 Arrangement of induction coils
31 First pair of induction coils
32 Second pair of induction coils
33 Third pair of induction coils
4 Base plate
5 Surface
6 Metal block
7 Cooling channels
8 Insulation
9 Cooling body
10 Temperature sensor
11 Power supply unit
12 Control/regulation unit
13 Container
14 Axis of symmetry
15 First direction of rotation
16 Second direction of rotation
17 Central plane
18 Meridional secondary flow
19 Azimuthal rotational flow
20 Side walls
21 Second melt
22 Third melt
23 Cooling device
$T_P$ Period
$T_{PM}$ Period for mixing
$T_{PE}$ Period at the beginning of solidification
$T_{Pause}$ Pause duration
$t_{i.a.}$ Initial adjustment time

The invention claimed is:

1. A method for the electromagnetic stirring of electrically conductive fluids in the liquid state and/or in the state at the beginning of the solidification of the fluid by using a rotating magnetic field which produces a Lorentz force in the horizontal plane, which comprises the direction of rotation of the magnetic field rotating in the horizontal plane is changed in regular time intervals in the form of a period ($T_P$), the frequency of the change in direction of the movement of the magnetic field vector being set in such a way that in the state of the mixing of the liquid fluid a period ($T_P$) between two changes in direction of the magnetic field in a time interval is provided as a function of the initial adjustment time ($t_{i.a.}$) with the condition that $$0.5 \cdot t_{i.a.} < T_{PM} < 1.5 \cdot t_{i.a.}, \quad \text{(I)}$$

and that at the beginning of the state of solidification of the fluid a period ($T_P$) is adjusted between two changes in direction of the magnetic field in a time interval as a function of the initial adjustment time $t_{i.a.}$ with the condition that $$0.8 \cdot t_{i.a.} < T_{PE} < 4 \cdot t_{i.a}, \quad \text{(II)}$$

the initial adjustment time ($t_{i.a.}$) being given by the equation $$t_{i.a.} = C_g \cdot \left( B_0 \sqrt{\frac{\sigma \omega}{\rho}} \right)^{-1} \quad \text{(III)}$$

in which after the rotating magnetic field is switched on in a fluid in a state of rest the double vortex of the meridional secondary flow is formed, and σ is defined as the electrical conductivity, ρ as the density of the fluid, ω as a frequency and $B_0$ as the amplitude of the magnetic field, and $C_g$ is defined as a constant for the influence of the size and shape of the volume of the fluid.

2. The method as claimed in claim 1, wherein in order to form the rotating magnetic field a rotary current in the form of a three-phase alternating current is applied to at least three pairs of induction coils placed on a cylindrical container containing the fluid.

3. The method as claimed in claim 1 wherein metal or semiconductor melts are poured as electrically conductive fluids into the container.

4. The method as claimed in claim 1, wherein the amplitude of the magnetic field is corrected in accordance with the height of the volume of the melt, which decreases in the course of the state of the directional solidification.

5. The method as claimed in claim 4, wherein in the state of a directional solidification under temperature control the amplitude of the magnetic field is increased in accordance with the course of the process such that the amplitude corresponds to the respective maximum of the two values $$B_1 = \sqrt{\frac{\rho}{\sigma\omega}} \cdot \frac{100 \cdot V_{sol}}{H_0} \quad \text{(IV)}$$

and

-continued $$B_2 = \sqrt{\frac{\rho}{\sigma\omega}} \cdot \frac{40 \cdot V_{sol}^{\frac{3}{2}}}{\sqrt{H_0 \nu}} \quad \text{(V)}$$

$\nu$ being defined as the kinematic viscosity of the melt, $V_{sol}$ being defined as the rate of solidification, and $H_0$ being defined as the height of the melt volume and $B_1$ and $B_2$ as lower limit values of the amplitude of the magnetic field $B_0$.

6. The method as claimed in claim 1, wherein the respective periods during mixing ($T_{PM}$) and the beginning of solidification in which the magnetic field is present and switched on are interrupted by pauses of pause duration in which no magnetic field is present at the melt, the pause duration being adjusted relative to the respective period with $T_{Pause} \leq 0.5 \cdot T_P$.

7. The method as claimed in claim 1, wherein other pulse shapes such as, for example, sine, triangle or sawtooth are implemented instead of the rectangular function when modulating the profile of the Lorentz force, the profile and the maximum value of the amplitude of the magnetic field being defined such that an identical energy input results for the various pulse shapes.

* * * * *